United States Patent [19]

Huang

[11] Patent Number: 4,819,530

[45] Date of Patent: Apr. 11, 1989

[54] APPARATUS AND METHOD FOR TRIMMING A VENETIAN BLIND ASSEMBLY

[75] Inventor: Chung-Chen Huang, Taipei, Taiwan

[73] Assignee: Teh Yor Industrial Co., Ltd., Taipei, Taiwan

[21] Appl. No.: 49,608

[22] Filed: May 13, 1987

[30] Foreign Application Priority Data

Nov. 17, 1986 [AU] Australia ..... 65195/86
Nov. 24, 1986 [AU] Australia ..... 64371/86

[51] Int. Cl.[4] ..... E06B 9/266

[52] U.S. Cl. ..... 83/39; 83/13; 83/516; 83/527; 83/701; 83/648; 83/925 R; 29/24.5

[58] Field of Search ..... 83/39, 516, 648, 527, 83/701, 925 R, 13; 29/24.5

[56] References Cited

U.S. PATENT DOCUMENTS 2,827,686 3/1958 Adelman ..... 29/24.5
3,766,815 10/1973 Edixhoven ..... 29/24.5 X
4,639,987 2/1987 Georgopoulous ..... 29/24.5

*Primary Examiner*—Donald R. Schran

*Attorney, Agent, or Firm*—Ashen Golant Martin & Seldon

[57] ABSTRACT

An automatic or semiautomatic apparatus cuts off the ends of preassembled standard venetian blinds to provide custom-size blinds for windows that are not modern standard sizes. An automated process is used to cut preassembled blinds to provide custom-size blinds for such windows. The apparatus preferably includes twin cutters arranged to trim both ends of a slat simultaneously, and is shaped, sized and configured to do so while the slat remains preassembled in a blind. The apparatus also preferably includes a vertical bed for suspending a blind in an opened and generally taut condition—and a mechanism for moving the cutter vertically along the bed to cut each slat in turn. Preferably the apparatus automatically registers the cutter with each slat and interrupts the cutting sequence after the last slat is cut. Optical sensing is preferably used to obtain the automatic registration. A motion-redirecting stage in the cutter mechanism allows a single driving cylinder or solenoid to both advance the cutter into cutting position and then actuate the cutter blade(s) to shear a slat. Symmetrical adjustment of the cutters relative to the long dimension of the slats enables the apparatus to make any of a great variety of custom blind sizes.

19 Claims, 4 Drawing Sheets

FIG. 4
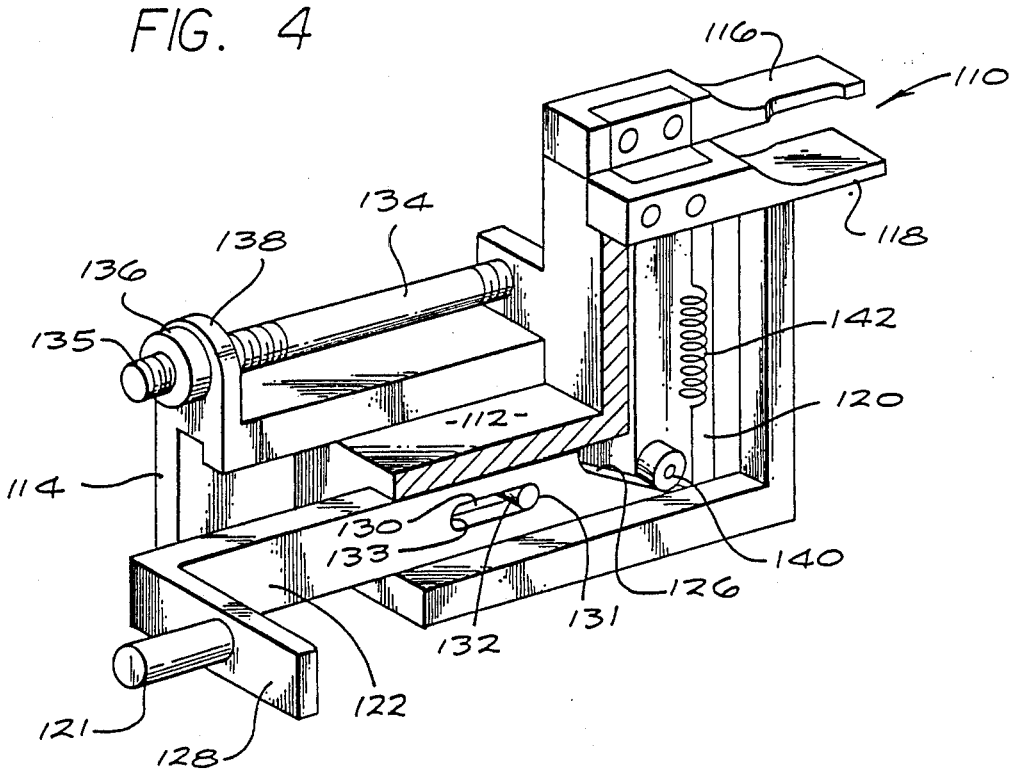
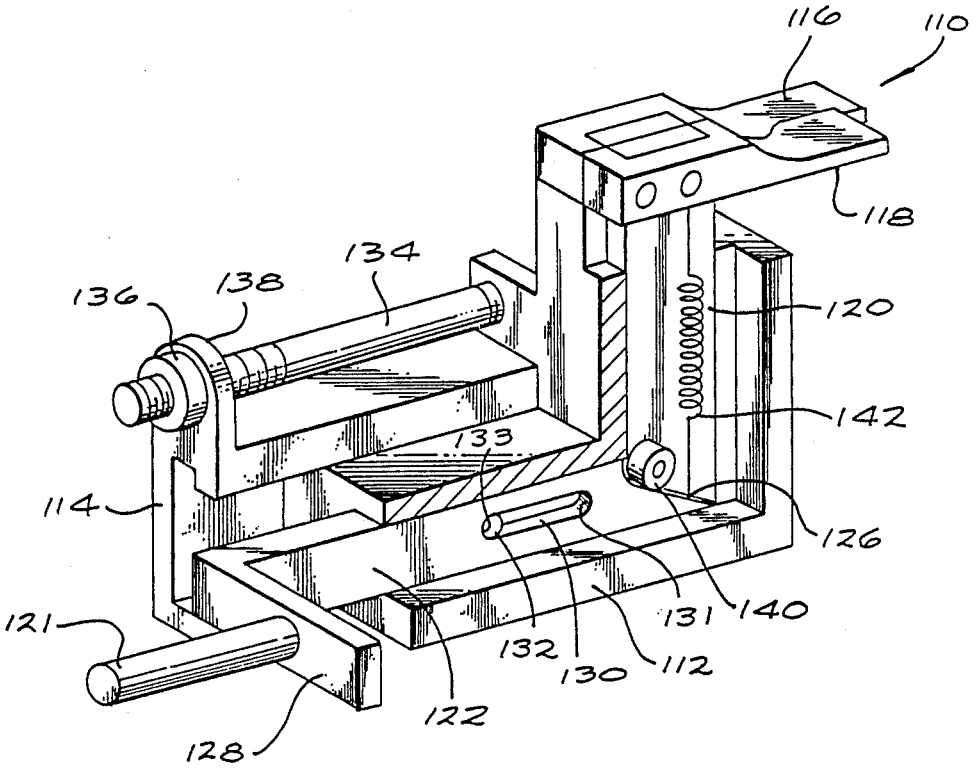
FIG. 5

APPARATUS AND METHOD FOR TRIMMING A VENETIAN BLIND ASSEMBLY

BACKGROUND

1. Field of the Invention

This invention relates generally to cutting devices that perform specialized functions; and more particularly an automated or semiautomated apparatus which cuts the ends of preassembled venetian blinds to provide custom-size blinds. The invention is also directed to a method for cutting such preassembled venetian blinds.

2. Prior Art

A venetian blind is a well-known window covering that can be placed in a window to regulate the passage of sun or air A venetian blind is generally made with a "top rail" or "head rail," a "bottom rail," and a number of thin, very generally planar slats of wood, metal or plastic that are uniformly spaced between the top and bottom rails.

The "top rail" is usually an elongated, U-shaped channel that is attached above or even with the top of the window casing. The "bottom rail" is usually an elongated bar made from wood, metal or plastic. The top rail includes or is operatively connected with a tilt mechanism, for purposes explained below.

The slats are usually supported by ladder tapes, one located near each end of the array of slats and rails. The ladder tapes are attached to the tilt mechanism or to the top rail and extend down to the bottom rail. Each ladder tape is generally made up of two mutually parallel vertical cords or strips—one in front of the slats and one behind them—connected to each other by a series of short cross-pieces of cord. Each cross-piece serves as a support for one end of one slat.

The tilt mechanism located in or connected with the top rail can be operated—typically by a control cord hanging near a first end of the rail. The tilt mechanism skews the ladder tapes and thereby tilts the slats through a wide range of angular positions.

A pull cord is typically affixed to the bottom rail, for use in lifting that rail to gather the slats and bottom rail together at the top. The cord passes through holes in the slats to a series of pulleys in the top rail, and hangs from a final pulley near a second end of the top rail.

At present, high-volume production machinery is used to manufacture venetian blinds in large quantities for modern standard window sizes. Unfortunately these blinds do not fit the windows in many old buildings, constructed to different standards.

Venetian blind manufacturers generally refrain from making blinds for such windows. The demand for such blinds—and consequently the efficiency and the return on investment in producing them—are very low relative to production-line work on modern standard sizes.

A person requiring a venetian blind for an "odd size" window usually finds a manufacturer willing to accept a special order for a custom-cut blind. Such a manufacturer, however, usually incurs large additional costs which he must pass on to the customer.

One alternative for a person needing an odd-size blind for a window in an old building is to contact antique or used-furniture stores to purchase an old, used blind that was specifically manufactured to fit the particular size of the window. As will be evident, however, success of such a search is hardly guaranteed. Furthermore, if such a blind is located it is an old, rather than a new venetian blind.

A person can purchase a new standard-size blind and live with the fact that it is larger or smaller than the window. As a last resort, such a standard blind might be hand-cut to size—but as far as I know that is unheard of On a commercial basis it is uneconomic, and on a do-it-yourself basis for most people it is tedious and nearly unfeasible. Special equipment is needed to cut slats neatly with proper shaping of the corners.

All these alternatives are plainly unsatisfactory. A venetian blind is an excellent window covering, but there is a need to facilitate preparation of custom-size blinds.

SUMMARY OF THE DISCLOSURE

The objective of the present invention is to simplify and ease the making of a custom-size venetian blind. The invention accomplishes this by providing an automated or semiautomated apparatus, or a procedure, for trimming the ends of the slats of a preassembled standard-size venetian blind to create a custom-size blind.

After the ends of the slats have been trimmed, the top and bottom rails can be cut to match the trimmed slats. Preferably this separate operation may make use of another cutting device located on the apparatus, or may be part of the procedure, of the present invention.

Thus a custom blind can be made easily and quickly on short notice, from a very common preassembled standard blind that is readily available at an ordinary retail or wholesale price. The invention obviates the need to disassemble, cut and reassemble the blind.

The invention can be placed in a retail or wholesale store which carries a supply of preassembled blinds of different standard sizes. Using the invention, a store employee is able—with minimal training and little effort—to trim the unwanted length from a standard blind to make a custom blind according to a customer's size requirements.

Thus the apparatus of the invention is an ideal accessory for a store that specializes in the sale of blinds. It can also be used, however, by a venetian blind manufacturer. A manufacturer may find it far easier and more economic to cut a standard-size venetian blind to a custom size than to use a production line to assemble one custom blind.

The preceding paragraphs provide an informal introduction to the disclosure. A more rigorous summary of the disclosure follows.

The invention provides an apparatus for trimming a plurality of slats of standard size and shape preassembled in a standard venetian blind. The apparatus necessarily includes some means for cutting a standard slat.

For purposes of generality in description, I shall refer to these means as the "cutting means." The cutting means are particularly shaped, sized and configured to trim the slats while the slats remain preassembled.

The apparatus also includes some means for disposing each of the slats of the venetian blind for cutting. Once again for generality, I shall call these means the "disposing means." The disposing means are also particularly shaped, sized and configured to stably support a standard slat while the array of slats remains preassembled.

These disposing means further include means—which I shall similarly designate as "aligning means"—for aligning the cutting means with each slat of the plurality, in sequence, for cutting. The aligning means operate while the slats are maintained preassembled.

The invention further includes means, herein called the "actuating means," for actuating the cutting means to cut a slat when the slat and the cutting means are relatively aligned. The actuating means are operatively linked with the cutting means.

The foregoing paragraphs may describe the invention in its broadest or most general form. There are other features, however, that are particularly desirable in preferred forms of the invention. Some of these features are described below.

In one preferred embodiment of the present invention, for description of which each slat is considered generally planar, the disposing means perform relative alignment of the cutting means and each particular slat by a component of relative motion that is very generally perpendicular to the plane of that slat. This component of relative motion occurs between successive operations of the actuating means.

It is well known that common venetian blind slats are not truly planar but rather have a slightly curved form in three dimensions. I mean to make clear that this slight curvature is to be disregarded in references to the "plane" of a slat. The slat can be conceptualized as generally planar, and reference to the plane of the slat then forms a verbal shorthand that is very useful in defining various directions relative to the slat.

A preferred embodiment also includes means, here called the "interference-preventing means," that help prevent relative interference between the slats and the cutting means during the above-mentioned relative motion of the cutting means and the slat.

The interference-preventing means provide another component of relative motion between the cutting means and the particular slat to be cut. This component of motion is generally parallel to the particular plane of that slat.

The invention can also take a form in which the disposing means include "suspending means," for suspending the blind by its head rail with the slats of the blind depending (i.e., hanging down) from the head rail. At least a portion of these suspending means is positioned above the cutting means.

Preferably the cutting means are particularly adapted for longitudinal motion relative to the plurality of slats—that is, motion parallel to the long dimension of each slat. In this form of the invention, the cutting means move to a selected position along each slat to cut the slat to a desired size.

Yet another form of the invention includes "stepping means" that move the cutting means along the plurality of slats to allow the cutting means to cut each slat in sequence. These stepping means may include automatic means for determining the position of each slat and for moving the cutting means into alignment with each slat for cutting.

Also desirable are "detecting means," used to detect the presence of a slat and thereby provide automatic registration of the cutting means with a slat to be cut. These detecting means are operatively associated with the disposing means in such a way that once the detecting means locate a slat to be cut, the disposing means then operate to cut the detected slat. After that slat is cut, the detecting means proceed to locate another slat so that it too may be cut. The detecting means continue to operate until all the slats in the plurality of slats are cut.

The present invention also includes a novel cutter for trimming the slats. This cutter utilizes "force applying means" that advance a pair of cutting blades toward alignment with the slat to be cut. The force applying means also cause the cutting blades to move toward each other, to cut a slat that has been aligned between the cutting blades.

The invention is also directed to a method for cutting preassembled venetian blinds to create custom-made blinds. In the summary that follows, the words "normal" and "parallel" refer to directions in relation to the plane of a slat that is under consideration. (As previously mentioned, this nomenclature is to be considered applicable even when, as is most often the case, the slats are slightly curved rather than strictly planar.)

The steps of the method include supporting the preassembled blind, and providing relative normal alignment between one of the slats and a cutter. Then relative parallel juxtaposition is provided between the cutter and that particular slat.

The slat is then cut, and through relative parallel motion the cutter is moved clear of the particular slat. The cutter and that slat can then be moved out of relative, normal alignment.

The process continues with relative normal alignment of the next slat. Generally speaking, these same steps are repeated in sequence until all the slats have been cut.

The present invention thus provides an automated or semiautomated cutting apparatus and method that are consistent, fast, and easy to use. The invention solves the problems encountered in obtaining a custom-made venetian blind.

All of the foregoing operational principles and advantages of the present invention will be more fully appreciated upon consideration of the following detailed description, with reference to the appended drawings, of which:

BRIEF DESCRIPTION OF THE DRAWINGS

FIG. 4 is a similar view of the FIG. 3 cutting assembly in a cutting position—but before the blades of the assembly are moved together to actually cut a slat.

FIG. 5 is a similar view of the same assembly in the same position, but with the cutting blades moved together for cutting of a slat.

FIGS. *7a*, *7b* and *7c* schematic end elevations showing how the detecting means detect the location of the slats and the head rail of a blind.

DETAILED DESCRIPTION OF THE PREFERRED EMBODIMENTS

Figure 1:
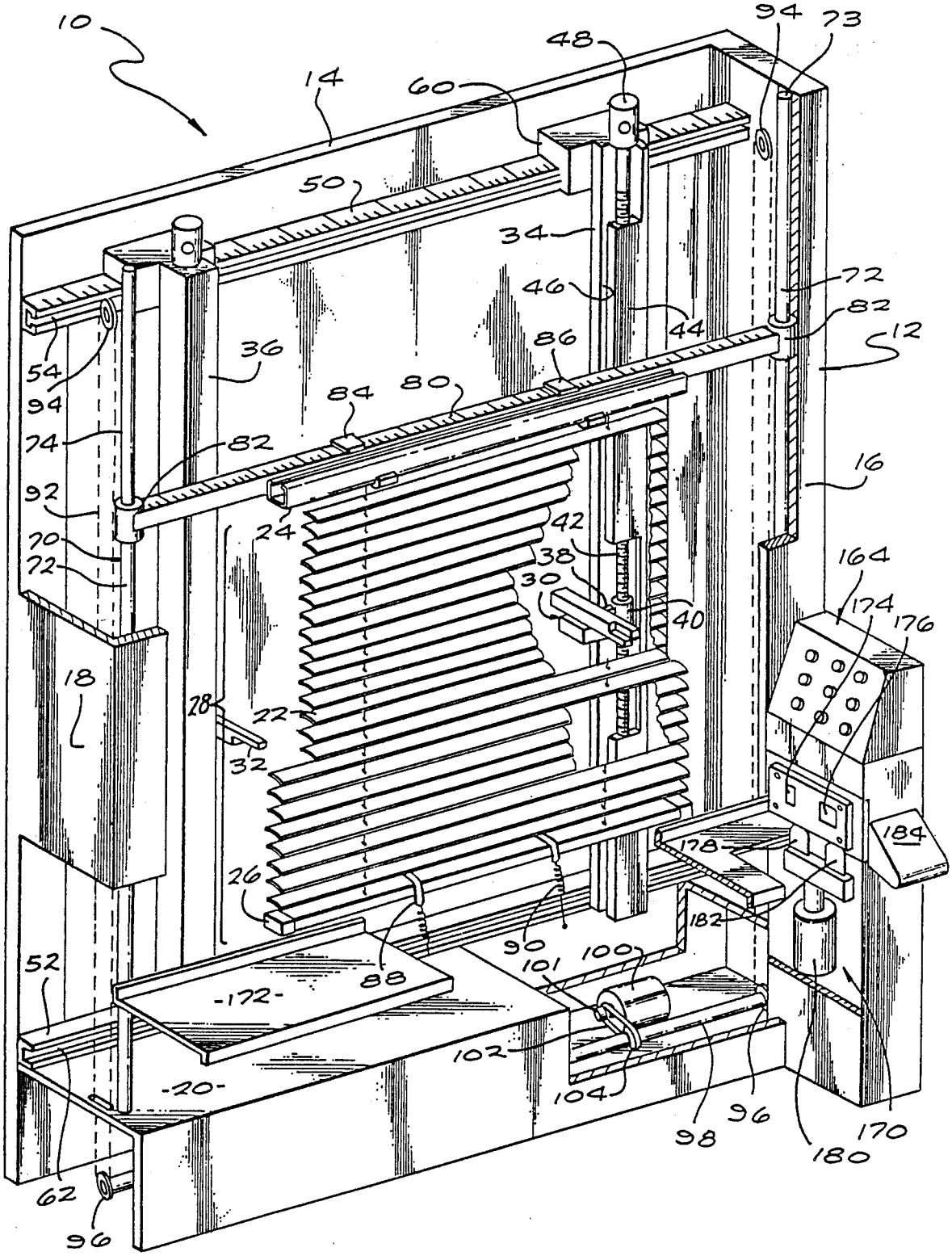
FIG. 1 is a perspective view of a preferred embodiment of the present invention (with portions of the frame or housing, and portions of the venetian blind, drawn cut away to better show the elements of the apparatus in detail).

My invention provides an apparatus 10, as shown in FIG. 1, for trimming a venetian blind. The apparatus includes an outer frame 12 having a back wall 14, a pair of side walls 16 and 18, and a base 20—all cooperating to support many of the other elements that make up the illustrated embodiment.

A typical standard-size venetian blind 22 is shown as it is mounted on the apparatus in a substantially opened condition. The blind 22 includes a top or head rail 24, a bottom rail 26, and a plurality of slats 28 that extend between the head rail 24 and bottom rail 26.

Figure 3:
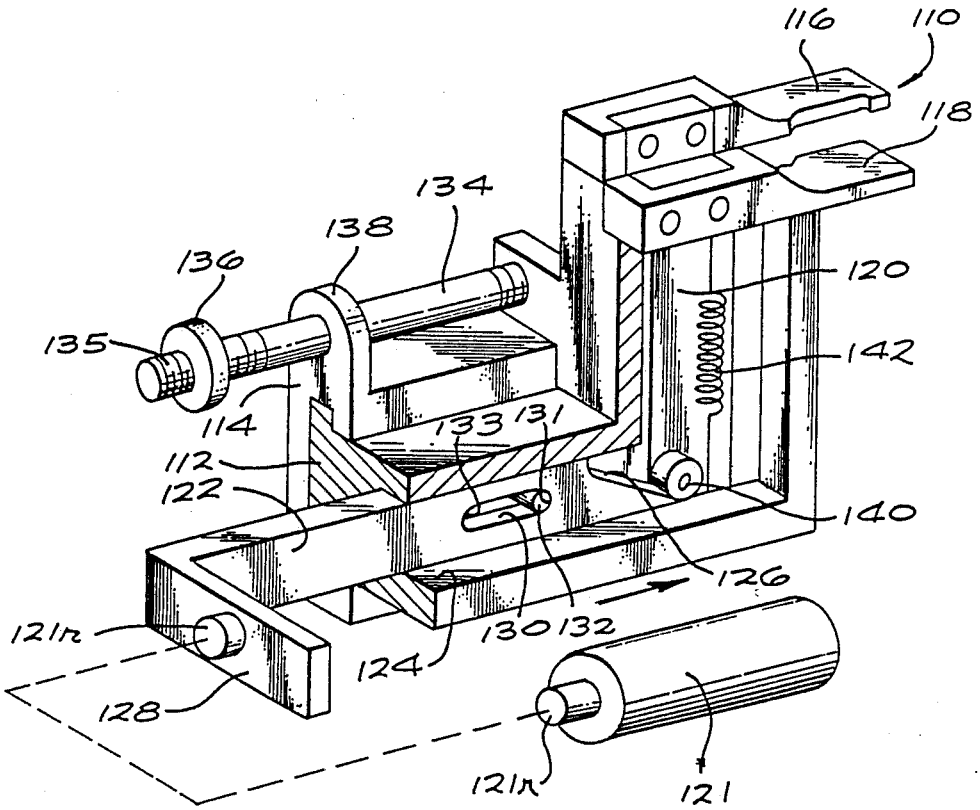
FIG. 3 is a perspective view of a slat-cutting assembly that can be used in the FIG. 1 embodiment, with the cutting assembly in a rest position. Portions of the cutter are drawn cut away to show the details of the cutter. A spring in the mechanism is shown schematically.

As illustrated, the apparatus 10 includes a slat-cutting assembly 30 (which in this embodiment serves as the "cutting means") near the right end of the venetian blind, for cutting the right ends of the slats. A second slat-cutting assembly 32 also appears in FIG. 1 near the left side of the blind, for cutting the left ends of the slats The specific structural elements that make up one form of the slat-cutting assembly are shown in FIGS. 3 through 5. They will be described in detail shortly.

The first-mentioned slat-cutting assembly 30 rides on a moving assembly 34 (serving as the "disposing and aligning means") that moves the slat-cutting assembly 30 relative to each slat of the venetian blind for cutting.

A similar moving assembly 36 moves the second slat-cutting assembly 32. For purposes of discussion, only the first-mentioned moving assembly 34 will be described in detail, since the second moving assembly 36 can be similar.

In the preferred form, the moving assembly 34 positions the slat-cutting assembly 30 vertically and horizontally along the blind 22. The slat-cutting assembly 30 is attached to a support arm 38 (FIG. 1) that is integral with a tapped sleeve 40. This sleeve in turn engages an elongated, threaded rod 42.

The threaded rod 42 is substantially perpendicular to the slats of the blind and stands within a movable housing 44. An elongated slot 46 extends vertically along the housing.

The threaded rod 42 is rotatably mounted within the movable housing 44 via a bearing (not shown) at the bottom of the housing. The top end of the threaded rod 42 is affixed to the shaft of a bidirectional motor 48 that is capable of turning the rod either clockwise or counterclockwise.

As the rod rotates, the sleeve portion 40 moves along the rod 42—either up or down, depending on the direction of rotation. The support arm 38 extends through the elongated slot 46 and transmits the vertical motion of the sleeve to the slat-cutting assembly 30.

The frame also includes an upper track 50 and a lower track 52 that are affixed to the back wall 14 and extend horizontally along the frame. The movable housing 44 rides on both of these tracks 50 and 52, carrying the slat-cutting assembly 30 horizontally along the frame.

Figure 2:
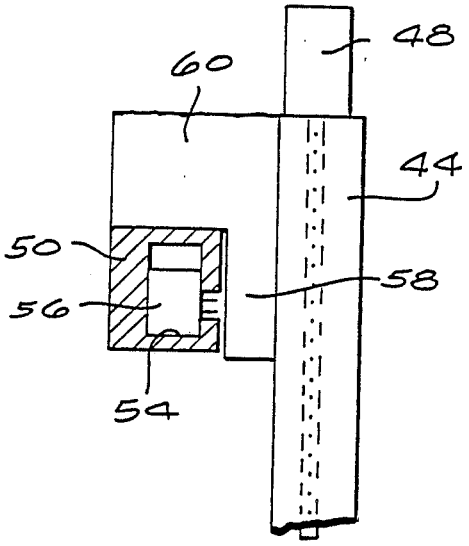
FIG. 2 is a somewhat schematic enlarged side elevation of a portion of the FIG. 1 embodiment, partly in section.

A groove 54 extends along the entire length of the track 50. Roller means such as a wheel 56, shown in FIG. 2, move within the groove 54.

The wheel 56 is attached to the shaft of another bidirectional motor 58. This motor 58 operates within a casing 60 that is also attached to the elongated movable housing 44.

The second bidirectional motor 58 drives the wheel 56 within the groove 54. The motor thereby propels the entire elongated housing 44 and the slat-cutting assembly 30 horizontally along the tracks.

The lower track 52 has a similar groove 62 extending along the length of the track. Another wheel (not shown) near the bottom of the elongated housing 44 allows the bottom portion of the housing to move along the lower track when the bidirectional motor 48 rotates the upper wheel 56.

Activating the bidirectional motor 58 thus provides horizontal movement of the slat-cutting assembly 30 parallel to the length of the slats. Preferably the left-hand slat-cutting assembly 32 is driven in common with the right-hand assembly 30, but in an opposite direction, to provide centered, symmetrical positioning of the cutting assemblies.

The apparatus 10 also includes a venetian blind holder 70 (serving as the "holding or suspending means"), mounted on the frame 12. As shown, this holder 70 includes a right-hand support post 72 and a left-hand support post 74, both welded or otherwise mounted to the base housing 20.

The right-hand support post 72 extends upward along the right side wall 16 and is welded or mounted to an upper flange or web 73 at the top of the side wall 16. The left-hand support post 74 similarly extends upward along the left side wall 18 (for clarity drawn partially broken away) and is attached to a like upper flange or web (not shown).

A rail-support member 80 spans the support posts 72 and 74. Each end of the rail-support member 80 has an end sleeve 82 that permits sliding engagement with the respective support post 72 or 74.

The rail-support member 80 also has graduations as shown, to aid in lateral centering of the head rail in the apparatus, and a pair of clamps 84 and 86 for fastening the head rail 24 firmly to the rail-support member 80. Tie-downs 88 and 90 extending from the base 20 are attached to the bottom rail 26 of the blind, to help maintain the blind in its opened position.

During the cutting operation, the blind is held substantially taut on the holder 70 to prevent any movement of the slats. The blind is placed in its opened condition after the head and bottom rails have been attached to the clamps and tie-downs respectively. This condition is achieved by moving the rail-support member 80 upward to fully extend the blind.

The rail-support member 80 is moved upward by an operatively associated chain-and-sprocket assembly. Each end of the rail-support member is attached to a respective elevator chain 92 (FIG. 1) that extends vertically along the corresponding side wall of the frame.

Each elevator chain is an endless loop, mounted on and between a pair of sprockets: an upper sprocket 94 near the top of the respective sidewall, and a lower sprocket 96 attached to a horizontally extending rotary control shaft 98. Both elevator chains are thus operated in common by this control shaft 98, which is driven by a bidirectional motor 100.

More specifically, a short chain 102, also an endless loop, encircles two sprockets—a drive sprocket 101 fixed on the shaft of the motor 100 and a driven sprocket 104 fixed on the rotary control shaft 98. Rotation of the control shaft 98 by the motor 100 and chain 102 thus moves the rail-support member either up or down, depending on the direction of rotation.

FIGS. 3 through 5 show the slat-cutting assembly 30 in greater detail. The slat-cutting assembly 30 includes a pair of cutting blades 110 (FIG. 3) supported by a carrier 112.

The carrier 112 rides along a guideway 114 that defines a path very generally parallel to the width of a slat to be cut. The carrier 112 moves on the guideway 114 from a rest position (depicted by FIG. 3) to a cutting position (FIG. 4) in which the two blades are respectively juxtaposed just above and below a slat to be cut.

The cutting blades 110 include a stationary blade 116 and a moving blade 118. A vertical driver bar 120 supports the moving blade 118 and raises it toward the stationary blade 116, to cut a slat (not shown) that has been positioned between the two blades. Thus the path of advance of the blade driver 120, and with it the moving blade 118, is generally perpendicular to the path of advancement of the carrier 112 on the guideway 114.

The slat-cutting assembly 30 also includes force-applying means in the form of a hydraulic or pneumatic cylinder or a solenoid 121, with a drive rod **121*r* that moves the carrier 112 from its rest position (FIG. 3) to its advanced position (FIG. 4). This cylinder or solenoid drive rod 121*r* is attached to a cam bar 122 that rides within a slot 124 formed on the carrier 112**.

The cam bar 122 has an inclined forward cam surface or face 126 formed at one end and a lug 128 at the other. The cylinder or solenoid drive rod **121*r* is generally affixed to this lug 128**.

An elongated slot 130 extends along part of the length of the cam bar 122 and receives a guide pin 132 that extends from the carrier 112. The function of this guide pin 112 and elongated slot 130 will be discussed shortly.

The guideway 114 and carrier 112 have limit means to halt the advancement of the carrier 112 along the carriage when the cutting blades 116, 118 have been properly aligned with a slat to be cut. As shown, these limit means include a stop rod 134 that is attached to the carrier 112 and slides within a boss 138 integral with the guideway 114.

A collar 136 is adjustably affixed along the rod 134. After the carrier 112 has advanced to a certain point along the guideway 114, the collar 136 strikes the boss 138 and prevents further advance.

The stop rod 134 is threaded at one end 135, and the collar 138 is correspondingly tapped, to facilitate fine adjustment of the collar 138 along the rod 134. The collar 138 is adjusted so that the cutting blades 116, 118 advance just to the correct position to properly cut a slat.

FIG. 4 shows the carrier in its advanced position. As illustrated, the limit means 134–138 prevent the carrier 112 from advancing further. When the mechanism is in this position, a slat (not shown) is directly between the stationary and moving blades 116, 118.

FIG. 5 shows the moving blade 118 driven upward to shear the slat. This condition is produced as follows.

Even after the carrier 112 is fully advanced, the force-applying means **121, 121*r* continue to apply a force on the lug 128 of the cam bar 122** as before. Intermediate force-redirecting means now come into operation, however, using the force on the lug to trim the slat.

More specifically, the redirecting means ride on the carrier 112. They redirect the force on the cam bar 122 to actuate the blade driver 120, which raises the movable blade 118 past the stationary blade to shear the slat.

In the embodiment shown, the redirecting means include the cam face 126 on the cam bar 122. The redirecting means also include mating cam-follower or roller means in the form of a wheel 140 attached to the blade driver 120.

In operation, before the collar 136 engages the boss 138, the force on the cam bar 122 drives the cutting assembly forward only because less force is required to do that than to push the cam bar 122 forward relative to the wheel 140. The cam bar 122 can move forward only by forcing the wheel 140 to roll upward along the inclined forward cam face 126. The wheel 140, however, is mounted to the blade driver 120, which is in turn biased downward by a tensioned spring 142.

Therefore the wheel can roll up the cam surface 126 only if the force applied to the cam bar 122 exceeds a threshold value determined by the spring tension, the angle of the cam surface 126, and friction in certain parts of the mechanism. The applied force cannot exceed that value as long as the cutting assembly can move forward.

After the limit means 134–138 come into engagement, however, the full force of the cylinder or solenoid 121 is available to cam the wheel 140 and the blade driver 120 upward against the spring action. Accordingly, as the force-applying means then continue to move the cam bar 122, the wheel 140 rolls up the inclined slope of the cam face 126.

The cam-follower wheel 140 continues to rise along the cam face 126, at least until the blade driver 120 has raised the movable blade 118 sufficiently toward (or beyond) the height of the stationary blade 116 to cut the slat. This ascent of the wheel 140, driver 120 and moving blade 118 is limited by the interaction of the pin 132 and slot 130.

More specifically, the cam bar 122 continues to move forward until the trailing end-wall 133 of the slot 130 engages the guide pin 132. At that point the moving blade 118 should be fully advanced and the slat should be completely sheared.

The significance of the length of the slot 130 can now be appreciated. The slot length corresponds to the free travel of the cam bar that must be available, after blocking of the carrier 112, to produce the full stroke of the blade driver 120.

Upon completion of the cutting operation, the cam bar can then be moved in an opposite direction by the same force-applying means. The wheel 140 rolls down the cam face 126, under the action of gravity and the tension in the spring 142, as the cam bar 122 is retracted. The blade driver is thus returned to its starting position.

The force-applying means continue to move the cam bar 122 back until the originally leading (now trailing) end-wall 131 of the slot 130 contacts the guide pin 132. The carrier 112 can now ride back along the guideway 114 as the cam bar 122 is further retracted by the force-applying means **121, 121*r***.

Thus both the carrier 112 and the blade driver 120 are advanced and retracted—but in mutually perpendicular directions. These orthogonal motions are produced using only a single force-applying means **121, 121*r***.

The apparatus also includes means operatively associated with the moving assembly for detecting the presence of a slat. One form of slat-detecting means, not visible in FIG. 1 but shown in FIG. 6, includes a photo-sensor device mounted on a U-shaped bar 152.

The bar 152 is affixed to the slat-cutting assembly and is extended around one end of the array of slats—to avoid hitting them when the cutting blades 110 of the slat-cutting assembly 30 are moved. The photo-sensor device 150 includes a light emitting source 154 located on one arm 155 of the U-shaped bar 152 and a receiver 156 located on the other arm 157 directly opposite the light source 154.

In operation the light-emitting source 154 emits a beam of light 153 (see FIGS. 6 and 7*a*) across the open end of the "U" of the bar 152. This beam 153 is picked up by the receiver 156.

When a slat 159 is placed directly between the light-emitting source 154 and the receiver 156 (FIG. 7*b*), the beam 153 strikes the slat 159 and fails to reach the receiver 156. Interruption of the light-beam continuity thus indicates the presence of a slat in front of the cutting blades 110.

Figure 6:
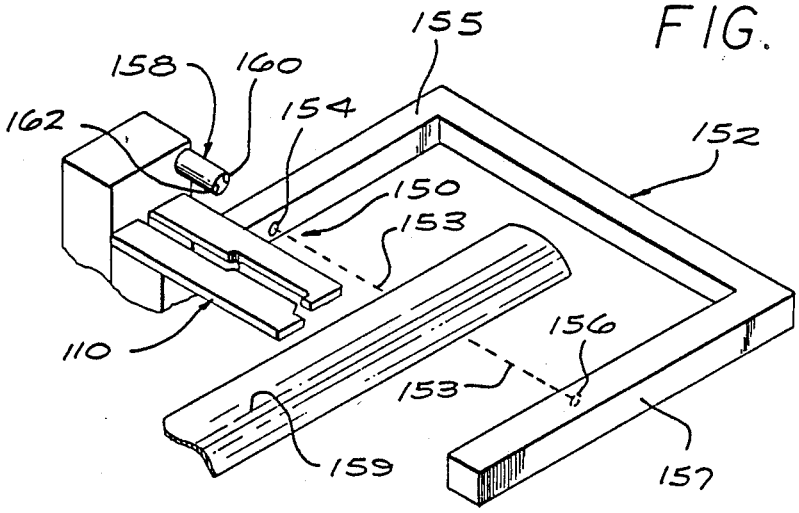
FIG. 6 is a somewhat perspective view showing the structure that forms the detecting means.

The apparatus also includes a second photo-sensor device 158, used to detect the head or bottom rail 24 or 26 of the venetian blind. This second photo-sensor device 158 is located directly above the previously mentioned light-emitting source 154, as shown in FIG. 6.

It includes both an emitter 160, that sends a beam of light 161 toward the slats, and a receiver 162 that detects the light beam 161 if the beam is reflected back from the head or bottom rail (see FIG. 7*c*) The emitter 160 and its receiver 162 are adjusted, however, so that a slat cannot reflect the emitted light beam 161 back to the receiver with sufficient strength to be detected.

This discrimination is readily effected since the edges of the rails are larger, and possibly more reflective, than the slats. Further, the slightly curved upper surfaces of the slats are not oriented to return the beam effectively.

Detection of the bottom rail 26 can be used to initialize sequencing of the cutting assembly 30 upward along the array of slats. Detection of the top rail 24 can accordingly be used to automatically stop the sequencing, since there are then no further slats to be cut.

In operation, a user first secures the venetian blind to the apparatus—by clamping the head rail 24 to the rail-support member 80, and securing the tiedowns 90 to the bottom rail 26. The driven chain-and-sprocket assembly 92–104 is then operated to raise the rail-support member 80, extending the blind to a somewhat taut, opened condition.

In addition, both cutting assemblies 30, 32 are adjusted laterally with respect to the apparatus, to provide the desired slat length. As will be understood, such "lateral" adjustment with respect to the apparatus corresponds to longitudinal adjustment with respect to the slats.

Figure 7A:
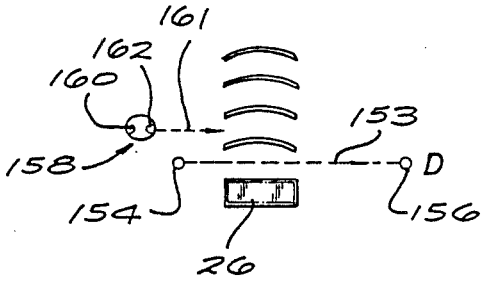
Figure 7B:
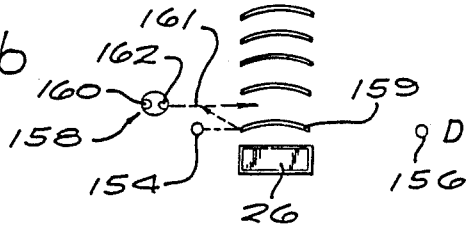
Figure 7C:
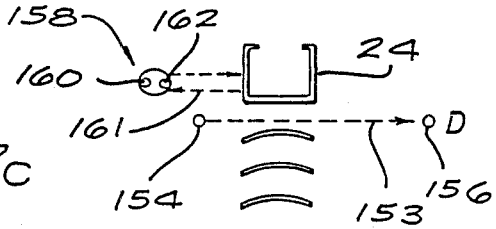

Next the slat-cutting assembly 30 is moved near the bottom of the venetian blind. FIGS. 7*a* through 7*c* depict the steps then performed by the detecting means.

The moving assembly is activated to raise the slat-cutting assembly 30 with its blades 110 (FIGS. 1 and 6), on which the source-and-detector array 154–162 is mounted. The source 154 directs a light beam 153 to the receiver 156.

The blades 110 continue to rise until the beam 153 is broken by a slat 159 (FIG. 7*b*). The blades 110 and optical array 154–162 immediately stop, since the blades 110 are in proper vertical (or "normal") alignment with the detected slat.

The blades 110 then move forward to cut the slat, as described earlier in connection with FIGS. 3 through 5. After the slat has been cut, the blades 110 move away from the venetian blind and again rise.

Meanwhile the first source 154 again emits a light beam 153, which as before is broken by the next slat. The blades 110 then again stop and are operated to cut this second slat. This process continues similarly, cutting the progressively higher slats.

The second light source 158 also emits a light beam 161 toward the blind during the detecting and cutting operations (see FIGS. 7*a* and 7*b*). The slats intercept this beam of light 161, but for reasons previously outlined do not return it to the second receiver.

The blades 110 continue to rise periodically along the blind, cutting each slat in turn as it is detected by the first photo-sensor device 150–157. Eventually the blades 110 cut the last remaining slat on the blind and then again rise.

At this point, the head rail 24 finally reflects the second light beam 161 to the receiver (see FIG. 7*c*). Thus the second photo-sensor device 158 detects the head rail 24, and halts sequencing of the blades 110.

The direction of travel of the slat-cutting assembly 30 is not critical and is largely a matter of design preference. Thus the apparatus can be programmed to lower, rather than raise, the blades 110 in the slat-cutting sequence.

In that mode of operation, however, the second photo-sensor device 158 should be mounted below the first photo-sensor 150–157. There it can detect the bottom rail 26 of the blind in time to halt the sequencing properly.

The apparatus further includes control means, represented in FIG. 1 by a control panel and box 164. These means include manual controls for entry of adjustments and operating-mode settings, as well as a "start" button or lever.

The control means also include programmed or programmable automatic sequencing devices that coordinate the motion of the various moving components during the cutting sequence. In addition the control means can include manual controls for overriding various functions, particularly including an emergency "stop" control.

One approach to provision of the control means for my apparatus is to design a relatively simple system of "hard wired" mechanical switches and relays. Individual semiconductor switches can be used instead.

Sequencing of such a system can be worked out by a senior electronics technician. Such a system is likely the most inexpensive arrangement if the apparatus is to be manufactured in a very small production volume.

Such a system, however, is unduly expensive for very large volume of production. It also may be relatively inflexible in suiting the speed, dynamic response and other operating parameters of the apparatus to the kinds and number of blinds to be trimmed.

For example, careful adjustments may be needed to stop the system consistently with the proper cutter-to-slat alignment. Such adjustments may drift with wear of the apparatus and even with variation in voltage, temperature, and other operating conditions.

A hard-wired switching control system or even an analog electronic circuit can be made to take such desired refinements into account. The cost per machine, however, becomes progressively greater as components are added for these purposes.

Perhaps at the other extreme, an integrated-circuit digital microprocessor can be custom-programmed to accept control settings and to perform the coordinating functions when the "start" control is operated. If desired, response of the apparatus to detection of a slat—and other basic operational characteristics of the apparatus—can be optimized within the program.

Such programming is within the capability of a person skilled in the art of custom programming of microprocessors. The programmer's work should be guided by the disclosure herein.

Introducing microprocessor control into my invention of course provides a far greater capability than needed for the relatively simple operations of the trimmer itself.

Such a system, however, can be made to perform many useful related functions.

Merely by way of example, it can accept operator-provided information on the desired length of the blinds, and automatically adjust the distance between cutters to provide that length. It can store such information for several relatively popular "almost standard" sizes, and allow the operator to select the particular desired size from any of those stored.

It can also count the number of cuts made on a blind and report the result for pricing purposes. Such a system can also keep track of the number of operating cycles (or even the force needed to operate the various components) and call for sharpening, lubrication, or other maintenance of the apparatus as needed.

It will be understood that a somewhat sophisticated circuit-design and programming effort is required to interface directly with a microprocessor chip and so provide the control means for the apparatus of my invention. Such a level of effort entails a relatively high start-up cost for the manufacturing project but very small unit cost thereafter, and so is compatible with a relatively high volume of production of the apparatus.

If preferred, for compatibility with intermediate production volume, a relatively inexpensive but already assembled and operating microcomputer can be used. All the same flexibility and expanded capabilities are available as with a custom-programmed microprocessor.

A less-sophisticated effort, however, is required to program a microprocessor in such a computer. The equipment cost per machine is likely to be intermediate beween those of the two possibilities described previously.

In any semiconductor-controlled system, as will be clear to those skilled in the art, low-impedance driving stages must be provided. Such electronics are needed to perform the step of directly actuating motors, solenoids, and the like, in response to individual transistors or a microprocessor.

In operation, the control means initially start the upward or downward movement of the slat-cutting assembly by actuating the bidirectional motor 48 that rotates the elongated rod 42. When a slat is detected by the detecting means, a signal is directed to the control means and the latter respond by causing the motor to stop—thus stopping the slat-cutting assembly when the cutting blades are aligned with a slat.

The control means then actuate the force-applying means to advance the cutter assembly toward the slat and then the movable blade toward the fixed blade to cut the slat. After the slat has been cut, the control means reverse the force-applying means to lower the movable blade and then move the assembly back to its rest position.

The control means continue these steps until all the slats have been cut. As already mentioned, the control means can also activate the motors 58 and 100 that control the length-adjusting movement of the slat-cutting assemblies and the vertical movement of the rail-support member.

It should be noted that a microprocessor-controlled system can be made to check the cutter-assembly position relative to a slat, readjust it if needed, and advance the cutter only when it is correct. With proper provisions for sensing of current, voltage, etc., it can also monitor the force required and the velocities attained in all four stages of the cutter-assembly motion—and in both of the twin cutter assemblies—independently.

Based on such monitoring it can alert the operator to the need for routine maintenance of specific components. It also can automatically halt operation of the system if the force or velocity, or a combination of such parameters, is outside acceptable operating ranges. Comparable monitoring and control functions can be provided for any of the other mechanisms in the apparatus.

The apparatus of my invention also includes a rail-cutting assembly 170, for use in cutting the head and bottom rails to match the size of the trimmed slats. FIG. 1 shows the rail-cutting assembly 170, at the right end of a workbench 172 that is directly above the base 20. (A portion of the workbench 172 has been drawn partially cut away, to better show the apparatus in detail).

The rail-cutting assembly 170 includes a pair of molded guide openings 174 and 176. These openings are shaped to match the cross-sections of the bottom and head rails respectively.

The assembly 170 further includes a pair of cutting blades 178 and 182, both mounted to a hydraulic or pneumatic cylinder 180. The cylinder moves the cutting blades 178, 182 upward to cut the unwanted portions from the rails inserted through the respective guide openings 174, 176.

In operation, one end of a rail is simply inserted into the proper opening 174 or 176 of the cutting assembly. The cylinder 180 is then activated to move the corresponding cutting blade 178, 182 across the rail, cutting off the undesired portion.

The opposite end of the same rail can then be inserted into the same opening to remove the unwanted portion from that end. After the rail is cut, the scrap piece falls through a chute 184 to the floor or a waste receptacle.

Due to space limitations in FIG. 1 the blades 178 and 182 are illustrated somewhat schematically as simple knife-type blades. It is to be understood, however, that these elements of the drawings equally well represent conventional rotary cutters.

Such cutters may well be preferred. They are readily mounted to a small platform positioned by the cylinder 180.

The apparatus described above can be constructed from various suitable materials, such as aluminum, steel or cast iron. Heavy-duty plastic or wood construction can be substituted if desired.

The apparatus can use either pneumatic or hydraulic cylinders, or other motive units such as electrical solenoids, to activate the various moving components.

The slat-trimming method of my invention includes, as a first step, supporting the preassembled venetian blind. (If my above-described preferred apparatus is used to carry out the method, this step corresponds to the previously discussed procedure for securing the blind to the apparatus )

The next step is to bring one slat of the blind into relative normal (as previously defined) alignment with a cutter. As will be understood, relative alignment may be produced by movement of either the slat or the cutter—or both.

The cutter and slat are then juxtaposed, in relative parallel alignment. (If my previously described preferred apparatus is in use, this juxtaposition step corresponds to forward advance of the carrier 112 of the slat-cutting assembly 30 along the guideway 114, laterally with respect to the slat.)

Relative parallel alignment can in principle be provided by movement laterally, with respect to the slat, or longitudinally—that is, in from the end of the slat to the desired cutoff position. A combination of lateral and longitudinal motions is likewise within the scope of my method invention.

The cutter can then cut the slat at the predefined position. (If my preferred apparatus is in use, this step is performed by moving the cam bar 122 to advance the moving cutting blade 118 relative the stationary blade 116; however, as will be appreciated, this method step can be effected with any of a great variety of equipment configurations.)

After the slat has been cut, the cutter and slat can be relatively "cleared." That is, they are moved sufficiently out of relative parallel alignment to allow relative normal motion of the cutter and slats without interference between them.

While they remain cleared, they are moved relatively in the normal direction to produce relative normal alignment of the cutter and the next slat. (For example, the cutter can move upward or downward next to a stationary vertical array of slats, as described in connection with my preferred apparatus.)

This slat and the cutter are, as before, juxtaposed in the relative parallel direction. Then the slat is cut, the cutter and slat are again "cleared," and relative normal alignment is provided with respect to yet another slat.

This sequence continues until the last slat to be cut is aligned with the cutter. The cutter and slat are juxtaposed and the slat is cut.

At this point, the cutting sequence is essentially finished since the last remaining slat has been cut. An additional step can be performed, however, afer the final slat has been cut: the cutter and slat can again be cleared, and if desired the last-cut slat and the cutting assembly can be dealigned in the normal direction.

This last step may be preferred for the sake of orderliness, though it is not strictly necessary. The trimmed blind can instead be simply demounted from whatever apparatus was initially used to support it.

There have been illustrated and described both apparatus and method that fulfill the objectives set forth above, providing all the corresponding advantages. It will be understood that the foregoing disclosure is intended to be merely exemplary, and not to limit the scope of the invention—which is to be determined by reference to the appended claims.

Many changes, modifications, variations and other uses and applications within the spirit and scope of the invention will become apparent to one skilled in the art upon consideration of this disclosure. They are accordingly all deemed to be within the compass of the invention.

I claim:

1. Apparatus for trimming a plurality of slats of standard size and shape preassembled in a standard venetian blind, comprising:

means for cutting such a standard slat;

the cutting means being particularly shaped, sized and configured to trim such slats while such slats remain preassembled in such a standard blinds;

means for disposing such a plurality of slats, and each such slat of such a plurality, for cutting, said disposing means:

being particularly shaped, sized and configured to stablely support such a plurality of standard slats, and each such slat of such a plurality, while such slats remain preassembled in such a standard blind, and including means for, while such slats remain preassemble in such a standard blind, relatively aligning the cutting means and each such slat of such a plurality, in a sequence, for cutting; and means, operatively linked with the cutting means, for actuating the cutting means to cut such a slat when such a slat and the cutting means are relatively aligned.

2. The apparatus of claim 1, for use in trimming such slats that are each very generally planar:

wherein the disposing means perform such relative aligning of the cutting means and each particular such slat, between successive operations of the actuating means, by a component of relative motion that is very generally perpendicular to he plane of that slat; and further comprising means for preventing relative interference between such slats and the cutting means during said relative motion.

3. The apparatus of claim 2, wherein:

the interference-preventing means provide another component of relative motion, between the cutting means add that particular slat, which component is very generally parallel to the plane of that slat.

4. The apparatus of claim 1, for trimming such a plurality of slats that makes up all the slats in such a standard venetian blind, wherein:

the cutting means operate with respect to all the slats of such a standard preassembled venetian blind.

5. The apparatus of claim 1, wherein:

the cutting means are particularly adapted to form a beveled or curved corner at a new end of such a slat.

6. The apparatus of claim 1, for use with such a venetian blind that also has a head rail, wherein:

the disposing means further comprise means, at least partially positioned above the cutting means, for suspending such a venetian blind by its head rail, with such slats depending from the head rail.

7. The apparatus of claim 6, wherein:

the cutting means are particularly adapted for motion relative to such a plurality of slats.

8. The apparatus of claim 7, further comprising:

means for stepping the cutting means along such a plurality of slats, to cut each such slat of such plurality in a sequence.

9. The apparatus of claim 8, wherein:

the stepping means comprise automatic means for determining the positions of such slats of such a plurality and moving the cutting means sequentially into alignment with each such slat of such a plurality for cutting of that slat.

10. A method for trimming very generally planar slats of standard size and shape preassembled in a standard venetian blind, comprising the following steps, wherein the directions "normal" and "parallel" as recited in any step are taken with respect to the plane of a slat identified in the same step:

(a) supporting the preassembled blind;

(b) while the standard blind remains preassembled, providing relative normal alignment between a cutter and a particular one of the slats; and then (c) while the standard blind remains preassembled, providing relative parallel juxtaposition between the cutter and the particular slat with which the cutter is now normally aligned;

(d) then while the standard blind remains preassembled, operating the cutter to cut that particular slat to a custom size;

(e) then while the standard blind remains preassembled, effecting relative parallel motion between the cutter and that particular slat, to provide clearance for relative normal motion of the cutter and that particular slat;

(f) then while the standard blind remains preassembled, providing relative normal alignment between the cutter and another particular uncut slat;

(g) then repeating steps (c) through (e) with respect to the just-mentioned other particular uncut slat, thereby cutting that slat to substantially the same custom size;

(h) then repeating steps (f) and (g) in turn, with respect to slats or a slat remaining uncut before each repetition, until all the slats of the blind have been cut; except that after cutting the last slat the repetition of the clearing step (e) may be omitted.

11. A method for trimming slats of standard size and shape preassembled in a standard venetian blind that has a head rail, comprising the steps of:

(a) suspending the blind by its head rail with a plurality of the slats depending below the head rail;

(b) while the standard blind remains preassembled, substantially aligning a cutter vertically with a particular one of the slats; and then (c) while the standard blind remains preassembled, moving the cutter substantially horizontally into cutting position relative to the slat with which it is now substantially vertically aligned;

(d) then while the standard blind remains preassembled, operating the cutter to cut that slat to a custom size;

(e) then while the standard blind remains preassembled, moving the cutter substantially horizontally out of cutting position to clear the cut slat to allow vertical movement of the cutter relative to that slat;

(f) then while the standard blind remains preassembled, substantially aligning the cutter vertically with another uncut slat;

(g) then repeating steps (c) through (e), thereby cutting the just-mentioned other slat to substantially the same custom size;

(h) then repeating steps (f) and (g) in turn, with respect to slats or a slat remaining uncut before each repetition, until all the slats of the blind have been cut; except that after cutting the last slat the clearing step (e) may be omitted.

12. A cutter for custom-trimming very generally planar slats of standard size and shape preassembled in a standard venetian blind, comprising: a pair of cutting blades;

a guideway for defining a path very generally parallel to the plane of a particular such slat, while that particular slat remains preassembled in such a standard blind;

a carrier that supports the cutting blades and is movably mounted on the guideway for motion along the path, for advancing such blades very generally parallel to the plane of such a slat so that such a slat is between them, while such slat remains preassembled in such a standard blind;

a blade driver, interposed between the carrier and one of the blades to support that blade, and movably mounted on the carrier for motion very generally perpendicular to the path to advance that blade toward the other blade while such slat is between them and remains preassembled in such a standard blind;

means for applying force to the carrier to draw the carried along the guideway to advance such blades, while such slat remains preassembled in such a standard blind;

limit means for engaging the carrier to halt advancement of the carrier along the guideway when the cutting blades have such a slat between them and are properly aligned for cutting such a slat; and intermediate force-redirecting means disposed on the carrier and arranged to transmit said applied force, with a change in direction, from the carrier to the blade driver after the carrier has engaged the limit means;

whereby after the force-applying means fully advance the carrier into cutting position the same force-applying means power the blade drive to trim such particular slat.

13. The cutter of claim 12, wherein:

the blades are shaped to form beveled or rounded corners in cutting a new end of such a particular slat.

14. A length-trimming machine for the slats of an assembled and extended venetian blind that has a head rail and a bottom rail connected by ladder tapes, with salts supported in the ladder tapes; said machine comprising:

a head-rail support;

head-rail clamping means on the head-rail support;

a bearing means at each end of the head-rail support;

two vertical posts respectively engaged in the bearing means;

first drive means for raising and lowering the head-rail support on the posts;

slat-trimming means comprising two trimming units, each trimming unit including:

a blade carriage;

second drive means, engaged with the carriage, for raising and lowering the carriage, a blade assembly comprising a pair of relatively movable slat trimming blades, the blade assembly being mounted on the blade carried for horizontal movement on the blade carriage between a work position, in which the blades are in cutting relationship with the slats of a blind mounted in the machine, and a rest position, third drive means for moving the blade pair between the work and rest positions, and fourth drive means for moving the blades relative to each other;

a carriage support for each blade carriage, each carriage support including:

a vertical track, and fifth drive means for moving its associated blade carriage along the vertical track;

upper and lower horizontal guides, each including a horizontal track;

the upper and lower ends of the carriage supports being respectively engaged in the tracks of the upper and lower horizontal guides for movement therealong;

sixth drive means for moving the carriage supports along the upper and lower horizontal guides; and control means for selectively operating the six drive means.

15. A machine as claimed in claim 14, wherein: the fifth drive means include:

threaded members engaged in threaded sockets in the blade carriages, electric motors to rotate the threaded members, and sensing means for detecting alignment of the blade pairs with a slat to be trimmed;

when the blade pairs are in the rest positions, the motors are energizable in response to an operations program in the control means; and the motors are deenergized in response to detection of such alignment by the sensing means.

16. A machine as claimed in claim 14, wherein each blade assembly includes:

a blade holder mounted on a blade carriage for horizontal movement between predetermined limits;

a cam bar mounted in the blade holder for movement in a horizontal direction relative to the blade holder, within predetermined limits;

a stationary blade mounted on a post on the blade holder;

blade mounted on a vertically movable bar in the blade holder;

a cam face on the can bar;

a cam-engaging member on the blade bar in engagement with the cam face;

means for biasing the cam bar to a lowered position, an interconnection between the blade holder and the cam bar limiting the relative movement therebetween; and means for applying force to the cam bar horizontally.

17. A machine as claimed in claim 16, wherein:

the horizontal force-applying means comprise a hydraulic assembly including a piston and a cylinder.

18. A machine as claimed in claim 14, wherein the first drive means include:

two pairs of sprockets, each including an upper sprocket and a lower sprocket;

two endless chains, each encircling and supported on one of the sprocket pairs;

connections between the chains and the respective bearing means; and means for driving the chains.

19. A machine as claimed in claim 14, wherein the fifth drive means include:

threaded holes in the blade carriages;

threaded rods engaged in the threaded holes; and reversible electric motors connected for driving the threaded rods.

* * * * *